US006253921B1

(12) United States Patent
Weder

(10) Patent No.: US 6,253,921 B1
(45) **Date of Patent: *Jul. 3, 2001**

(54) PACKAGING MATERIAL

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/516,072

(22) Filed: Mar. 1, 2000

Related U.S. Application Data

(63) Continuation of application No. 09/317,394, filed on May 24, 1999, which is a continuation of application No. 08/892,675, filed on Jul. 14, 1997, now Pat. No. 5,906,280.

(51) Int. Cl.[7] ..... B65D 81/02
(52) U.S. Cl. ..... 206/584; 206/521; 428/402
(58) Field of Search ..... 206/584, 423, 206/521, 525.1; 428/402

(56) References Cited

U.S. PATENT DOCUMENTS

| | | | |
|---|---|---|---|
| 3,047,136 | 7/1962 | Graham | 206/584 |
| 3,074,543 | 1/1963 | Stanley | 206/584 |
| 3,314,122 | 4/1967 | Bundy | 28/1 |
| 3,485,428 | 12/1969 | Jackson | 226/97 |
| 3,560,313 | 2/1971 | Herkimer | 16/9 |
| 4,153,488 | 5/1979 | Wiegand | 156/62.2 |
| 4,199,627 | 4/1980 | Weder et al. | 428/7 |
| 4,292,266 | 9/1981 | Weder et al. | 264/140 |
| 4,401,700 | 8/1983 | Weder et al. | 428/17 |
| 4,418,103 | 11/1983 | Tani et al. | 428/4 |
| 4,549,908 | 10/1985 | Weder et al. | 106/266 |
| 4,568,581 | 2/1986 | Peoples, Jr. | 428/35 |
| 5,020,672 | 6/1991 | Watts | 206/575 |
| 5,134,013 | 7/1992 | Parker | 428/182 |
| 5,312,665 | 5/1994 | Pratt et al. | 428/402 |
| 5,397,413 | 3/1995 | Trimble et al. | 156/167 |
| 5,472,779 | 12/1995 | Cann et al. | 428/402 |
| 5,603,406 | 2/1997 | Weder | 206/423 |
| 5,674,344 | 10/1997 | Thompson et al. | 206/584 |
| 5,699,645 | 12/1997 | Vaccarello | 206/584 |
| 5,897,926 | 4/1999 | Mikulas | 428/17 |
| 5,906,280 * | 5/1999 | Weder | 206/584 |
| 5,992,637 * | 11/1999 | Weder | 206/584 |
| 6,053,323 * | 5/1999 | Weder | 206/584 |

OTHER PUBLICATIONS

Exhibit A—"Beauty Grass" brochure, not dated, published by Applicant, showing shredded grasses for sale.
Exhibit B—"Highlander® Easter Season Headquarters" brochure, not dated, published by Applicant, showing shredded grasses for sale.
Exhibit C—"Make Highlander® Your Headquarters for Easter and Other Holidays" brochure, published in 1991 by Applicant, showing shredded grasses for sale.
Exhibit D—Undated brochure, published by Applicant, showing shredded grasses for sale.

* cited by examiner

*Primary Examiner*—David T. Fidei
(74) *Attorney, Agent, or Firm*—Dunlap, Codding & Rogers, P.C.

(57) ABSTRACT

A packaging material comprising a plurality of flexible strips of material intertwined with and bondably connected to one another so as to form a cohesive cushioning unit and method for forming same is provided. The strips of material have a bonding material disposed thereon for bondingly connecting the strips of material to one another and enabling the strips of material to be bondingly connected to a container and an article.

15 Claims, 3 Drawing Sheets

PACKAGING MATERIAL

CROSS-REFERENCE TO RELATED APPLICATIONS

This application is a continuation of U.S. Ser. No. 09/317,394 filed May 24, 1999; which is a continuation of U.S. Ser. No. 08/892,675, filed Jul. 14, 1997, now U.S. Pat. No. 5,906,280.

STATEMENT REGARDING FEDERALLY SPONSORED RESEARCH OR DEVELOPMENT

Not applicable.

BACKGROUND OF THE INVENTION

1. Field of the Invention

The present invention relates generally to packaging materials for packaging articles, and more particularly, but not by way of limitation, to a packaging material which includes a plurality of resilient members bondably connected to one another to form a cohesive cushioning unit.

2. Brief Description of the Related Art

In the process of shipping an article from one location to another, the article is typically placed in a container along with a protective packaging material to fill the voids about the article and to cushion the article during the shipping process. One common protective packaging material is comprised of a plurality of plastic foam, peanut-shaped members which are commonly known as "styrofoam peanuts." An advantage in using styrofoam peanuts is the ease with which they may be disposed about an article positioned in a container by simply pouring the styrofoam peanuts from a dispenser.

However, while styrofoam peanuts have been widely accepted in the packaging industry, they are not without disadvantages. For example, the light weight and flowability of the styrofoam peanuts results in heavier objects gravitating through the peanuts to the bottom of the container where the object can be damaged. Also, while the flowability of the styrofoam peanuts facilitates the introduction of the peanuts into a container, the receiver of the package is left with having to deal with the peanuts upon removal of the article from the container in the form of having to clean up the mess left by the peanuts which are easily scattered upon removal of the article from the container.

These and other disadvantages associated with the disposal of styrofoam peanuts, has made paper protective packaging material a popular alternative. Paper is biodegradable, recyclable and renewable, making it an environmentally responsible choice. However, like styrofoam peanuts, paper packaging materials is not without disadvantages in that paper, particularly shredded paper, can be inconvenient to clean up and to dispose of due to the lack of cohesiveness of the packaging material. In addition, due to the lack of resiliency in paper products, large amounts of paper are typically required to provide the bulk needed to adequately cushion an object.

Strips of sheet material formed into tufts have also been used for many years. More specifically, material known as decorative grass has been used in fruit baskets, Easter baskets, and picnic baskets and for other decorative purposes. In addition, decorative grass has been use as a packaging material. The decorative grass of the prior art has been produced by numerous methods and from a variety of materials such as polymeric materials, paper, cellophane or the like. Typically, such materials are cut and shredded to produce segments having predetermined dimensions. As such, decorative grass, like styrofoam peanuts and paper materials described above, can be inconvenient to clean up and to dispose of.

To this end, a packaging material is needed that includes a plurality of resilient strip members intertwined with and bondably connected to one another so as to form a cohesive cushioning unit. It is to such a packaging material that the present invention is directed.

BRIEF SUMMARY OF THE INVENTION

The present invention is directed to a packaging material for use in filling baskets and protecting articles during a shipping process. The packaging material include a mass of randomly arranged individual, thin, flexible strips of material intertwined to form a resilient tuft. The strips of material have a bonding material disposed thereon such that the strips of material are bondingly interconnected to adjacently disposed strips of material.

The present invention is also directed to a method for making a packaging material which generally includes the steps of slitting a flexible sheet of material to provide a sheet of material containing a plurality of strips having a predetermined width, applying a bonding material to the slitted sheet of material, cutting the slitted sheet of material to provide a plurality of individual, narrow strips of flexible material, and randomly arranging the strips of material into a mass so as to intertwine and bondingly connect the strips of material to form a resilient, cohesive tuft.

The tuft formed from the plurality of strips of material may be incorporated into a package which additionally includes a container and an article positioned within the container. The tuft is arranged about the article to substantially surround the article positioned within the container. The tuft may also be caused to bond to the article and the container. In this manner, the tuft will function as a protective packaging material which fills any voids and/or which cushions the article during a shipping process.

The objects, features and advantages of the present invention will become apparent from the following detailed description when read in conjunction with the accompanying drawings and appended claims.

DETAILED DESCRIPTION OF THE INVENTION

Figure 1:
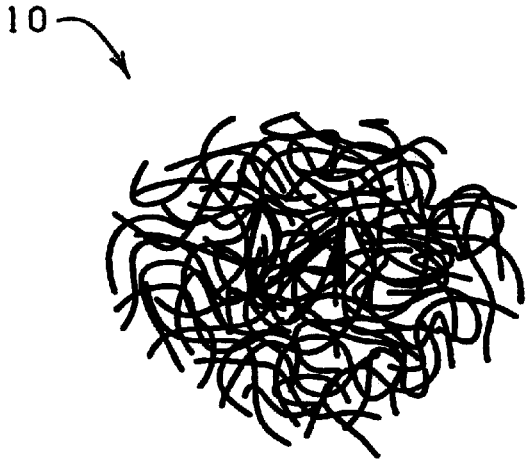
FIG. 1 is a perspective view of a tuft of packaging material constructed in accordance with the present invention.
Figure 2:
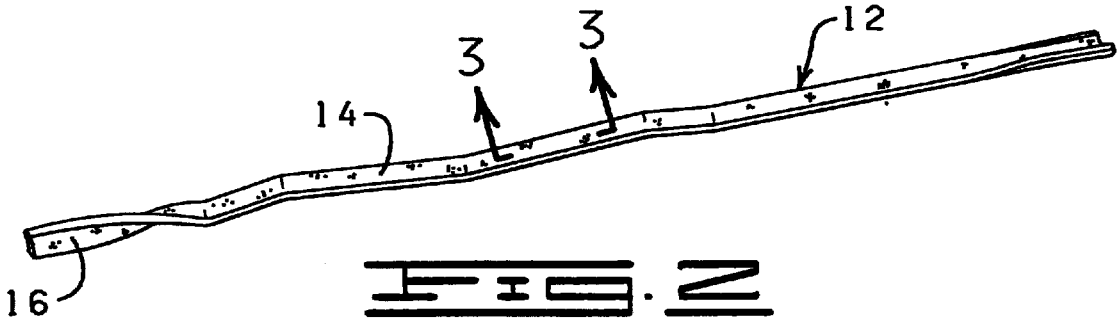
FIG. 2 is a perspective view of a strip of material used to form the tuft of packaging material of FIG. 1.
Figure 3:
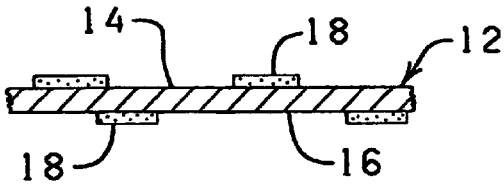
FIG. 3 is a enlarged, fractional, cross-sectional view of the strip of material shown in FIG. 2 taken along line 3—3 of FIG. 2.

Referring now to the drawings, and more specifically to FIGS. 1–3, a tuft 10 of packaging material constructed in accordance with the present invention is illustrated in FIG. 1. The tuft 10 is comprised of a plurality of individual strips or strands of material 12 (FIG. 2), each characterized as having a first side 14 and a second side 16. The strips of material 12 can be fabricated from any flexible sheet of material, including paper, crepe paper, polymeric film, laminated polymeric film, and waxed paper, for example. The sheet of material may have printed matter and/or embossed pattern on at least one side thereof, and the embossed pattern can be either in register or out of register with the printed pattern.

The printed pattern can be printed on the sheet of material in a conventional matter so that, when the sheet of material is slit and cut to produce the strips of material 12, at least a substantial portion of the strip of material 12 contains at least a portion of the printed pattern. Further, different colors can be employed to provide the printed pattern on the sheet of material.

The sheet of material can also be embossed so as to provide the sheet of material with an embossed pattern. Further, the sheet of material can be provided with an embossed pattern as well as a printed pattern, and the embossed pattern can be either in register or out of register with the printed material and/or printed design.

The strips of material 12 as briefly described above are referred to as "Easter grass" or "decorative grass", and as mentioned above, decorative grass has been used for many years for filling fruit baskets, Easter baskets, and picnic baskets and for other decorative and packaging purposes. The decorative grass of the prior art has been produced by numerous methods and from a variety of materials, such as those listed above. Typically, such materials are shredded and cut to produce segmented strips having predetermined dimensions. While the prior art methods for making decorative grass have been widely accepted, new methods for making decorative grasses with different aesthetic and functional qualities have been sought.

One technique for achieving these desired effects is to coat the strips of material 12 with a bonding material such as an adhesive or cohesive whereby the individual strips of material 12 are caused to stick together when a plurality of the strips of material 12 are amassed to form a tuft, such as the tuft 10 shown in FIG. 1. As best shown in FIG. 3, the strip of material 12 is provided with a bonding material 18. The strip of material 12 is illustrated in FIG. 3 as being spot coated with the bonding material 18 on the first side 14 and the second side 16 wherein the bonding material 18 is disposed as randomly disposed spots on the first and second sides 14 and 16 of the strip of material 12. It will be appreciated, however, that the bonding material 18 may be applied in such a manner as to substantially cover one or both of the first and second sides 14 and 16 of the strip of material 12, or as strips. Further, the bonding material 18 may be disposed in any of a variety of other patterns such as circles, dots or any other geometric or biomorphic shape, including decorative designs, so long as the bonding material 18 is positioned to function in accordance with the present invention.

The term "bonding material" when used herein can mean an adhesive, frequently a pressure sensitive adhesive, or a cohesive or any adhesive/cohesive combination, having adhesive qualities (i.e., qualities of adhesion or adhesion/cohesion, respectively) sufficient to effect the connection between adjacent strips of material 12 brought into engagement with one another, between the strips of material 12 and an object such as a basket, box or other container and objects disposed in such containers. It will be appreciated that both adhesives and cohesives are well known in the art, and both are commercially available.

Figure 4:
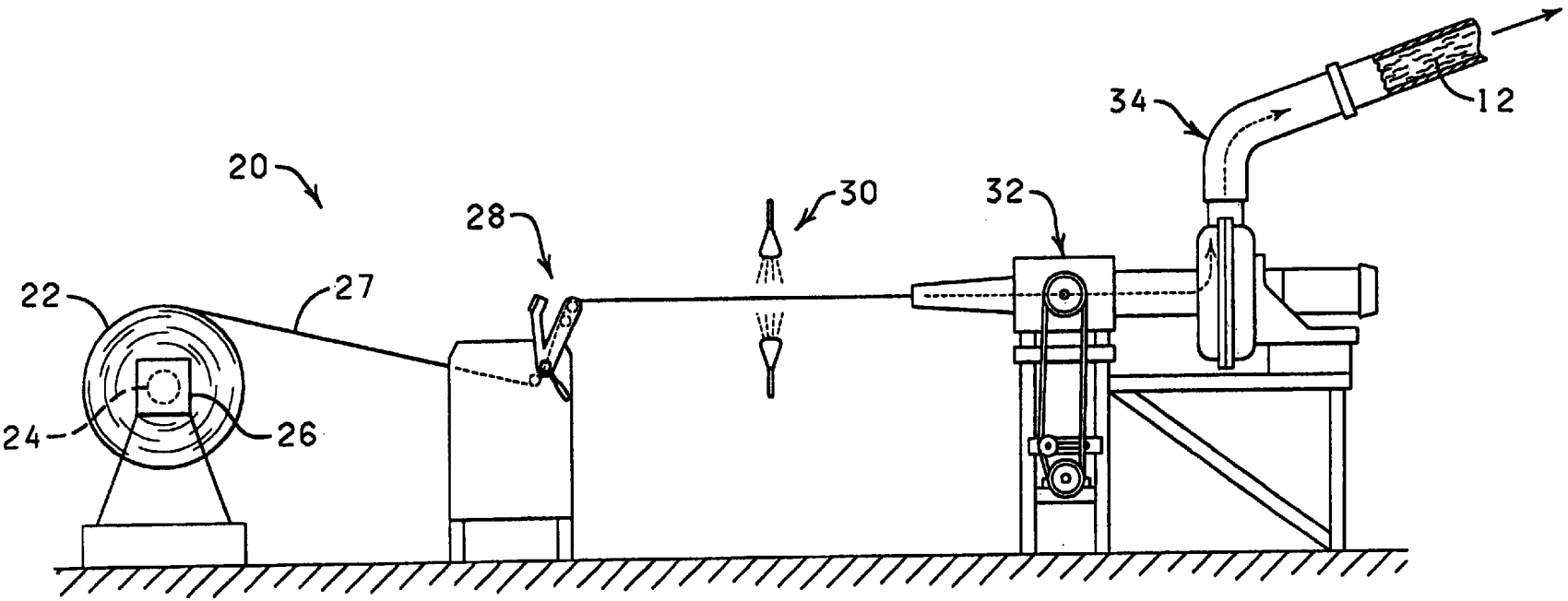
FIG. 4 is a schematic representation of a system for making the strip of material of FIG. 2.

FIG. 4 schematically illustrates a system 20 for making strips of material 12 in accordance with the present invention. The system 20 includes a roll of material 22 supported on a shaft 24 having a brake assembly 26 operably connected thereto for controlling the rate of withdrawal of the material from the roll of material 22.

The roll of material 22 provides a web of sheet material 27 which is passed through a slitter 28. The slitter 28 includes a plurality of spaced apart, stationary knives or other conventional cutting mechanism, which slit or cut the web of sheet material 27 into strips or strands of desired width.

An effective amount of the bonding material 18 is next applied to the slitted web of sheet material 27 to provide the desired coverage by a spray assembly 30, or by some other suitable means for applying the bonding material such as, for example, by brushing or rolling the bonding material onto the slitted web of sheet material 27.

After the bonding material 18 has been applied to the slitted web of sheet material 27, the slitted web of sheet material 27 is passed into a cutter 32 where the slitted web of sheet material 27 is cut into predetermined lengths so as to form the strips of material 12. From the cutter 32, the strips of material 12 are conveyed by a conveyor unit 34, which is in the form of a centrifugal blower, to a storage area (not shown) which may be in the form of a suitable bin, packaging machine, or the like.

As an alternative to forming the decorative grass from the roll of material 22, it will be appreciated that the strips of material 12 may be formed from a polymeric film discharged from a film extrusion die which is then chilled prior to the slitting process. Such a method is disclosed in U.S. Pat. No. 4,292,266, entitled "Process for Making Decorative Grass", issued to Weder et al. on Sep. 29, 1981, which is hereby expressly incorporated herein by reference. Also, while the bonding material 18 is shown herein as being applied to the web of sheet material 27 after the slitting step, it will be appreciated that the bonding material 18 may be applied to the web of sheet material 27 prior to the slitting step or to the formed strips of material 12 after such are cut to length.

As illustrated in FIG. 2, the strips of material 12 tend to curl and form folds during the forming process. It will be appreciated that these curls and folds contribute to the resiliency and bulkiness or fluffiness of the tuft 10 produced by amassing and intertwining a plurality of the strips of material 12. It will be further appreciated that the degree to which the strips of material 12 are curled and folded can vary dependant on several factors, such as the type of material used to form the strips of material 12, as well as the type of bonding material applied to the strips of material 12 and the amount of bonding material applied.

Figure 5:
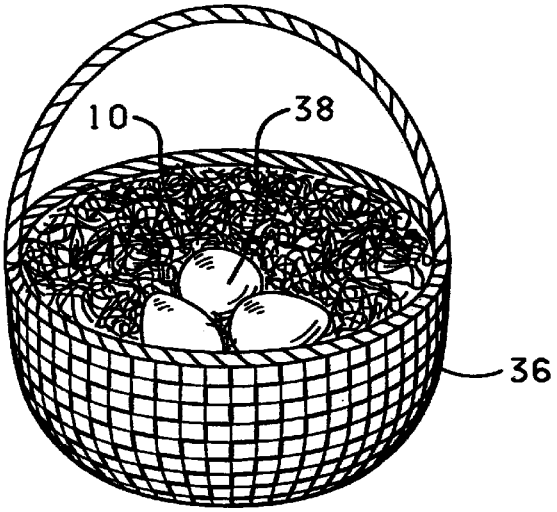
FIG. 5 is a perspective view of a basket having a tuft of packaging material disposed therein with a plurality of objects displayed on the tuft.
Figure 6:
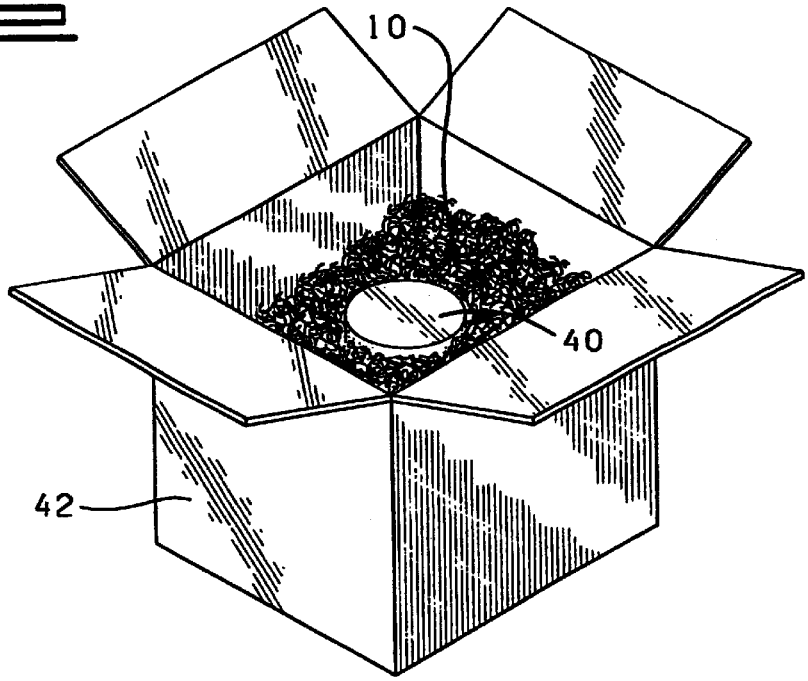
FIG. 6 is a perspective view of a package illustrating the tuft of packaging material used as a packaging material for cushioning article during a shipping process.

In use, the strips of material 12 are amassed, intertwined, and bondably connected to form the tuft 10. FIG. 5 illustrates one use of the strips of material 12 described above. That is, the tuft 10 fabricated from the strips of material 12 is shown disposed in a basket 36 and supporting a plurality of objects 38, such as candies or Easter eggs, for display. FIG. 6 illustrates an alternative use for the strips of material 12. In FIG. 6, the tuft 10 fabricated from the strips of material 12 is being used as a packaging material for protecting an article 40 disposed in a container 42. In this manner, the tuft 10 functions as a protective packaging material which fills any voids and cushions the article during transport.

An advantage of applying the bonding material 18 to the strips of material 12 is that the degree of springiness or fluffiness of the tuft 10 can be controlled. That is, a problem experienced with the use of some decorative grasses in the filling of gift baskets and Easter baskets is that the fluffiness or springiness of the decorative grass causes objects, such as candy and fruit, displayed on the decorative grass, to be expelled from the basket or moved to a different position in the basket. As such, it is desirable to be able to control the amount of resiliency or springiness of the decorative grass. By bonding the strips of material 12 to one another, the degree to which the strips of material 12 are able to flex relative to one another can be controlled through the amount of bonding material 18 applied to the strips of material 12 and the tack of the bonding material 18.

Another advantage of having the strips of material 12 bond to one another includes the mess associated with loose packing or filler materials falling onto the floor or clinging to various objects being alleviated. Also, the tuft 10 fabricated of the strips of material 12 can be caused to adhere or cohere to an object and/or container resulting in an enhanced packing effect. That is, with loose packing materials, the object being packed has a tendency to gravitate through the packing material to the bottom of the container thereby reducing the effectiveness of the packing material. By using the strips of material 12 disclosed herein, the cohesiveness of the tuft 10 surrounding the object prevents the object from gravitating through the decorative grass.

In addition, the use of a bonding material 18 on the strips of material 12 enhances the shape sustaining characteristics of the tuft 10. When the strips of material 12 are amassed to form the tuft 10, each strip of material 12 is normally bent and folded when a crushing force is applied to the tuft 10 whereby the strips of material 12 are caused to be flattened thereby giving the tuft 10 a lesser cushioning quality. With the strips of material 12 adhered to one another, the strips of material 12 are caused to maintain their folds in opposition to forces attempting to flatten the folds, thereby giving the tuft 10 greater crush resistance and providing enhanced capabilities as a functional packaging material in that the strips of material 12 which are more difficult to crush would continue to occupy space and create a cushioning effect. As such, a lesser quantity of the strips of material 12 provided with the bonding material 18 could have the same cushioning effect and occupy the same volume as that of a larger quantity of non-treated strips of material.

In addition to the functional advantages provided by the strips of material 12, the ability of the strips of material 12 to adhere to one another also permits the creation of various decorative effects. For example, because the strips of material 12 are able to adhere to one another, one may cause the strips of material 12 to clump in a variety of different configurations. In other words, the strips of material 12 treated with the bonding material 18 can be manipulated into a desired form or shape as to result in a desired decorative effect.

It will be appreciated that the qualities and characteristics of the tuft 10 formed from a plurality of the strips of material 12 can be varied depending on the number of surfaces of the strip of material 12 the bonding material 18 is applied to, the pattern in which the bonding material 18 is applied, and the tackiness of the bonding material 18 used.

Figure 7:
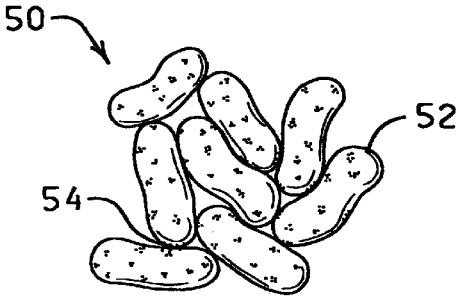
FIG. 7 is a perspective view of a mass of styrofoam peanuts constructed in accordance with the present invention.

In addition to the above mentioned advantages of the strips of material 12 treated with the bonding material 18, FIG. 7 illustrates the concept of treating other conventional packaging materials with a bonding material to form a cohesive unit. More specifically, FIG. 7 illustrates a packaging material 50 comprising a plurality of plastic foam, peanut shaped members 52, which are commonly known as "styrofoam peanuts", coated with a bonding material 54. The bonding material 54 can be any suitable adhesive or cohesive which can be used to effect the bonding or connecting of two adjacent styrofoam peanuts 52. Also the "tack" of the bonding material 54 may be varied depending on the bonding characteristics desired. The bonding material 54 may be disposed on the outer surface of the styrofoam peanuts 52 by any conventional manner which may include spraying, rolling, or brushing. Also, the bonding material 54 may be applied to the styrofoam peanuts 52 as a solid coat, strips, spots, or any combination thereof.

By treating the styrofoam peanuts 52 with the bonding material 54, the problems associated with objects gravitating through the peanuts to the bottom of a container is reduced or eliminated and the mess associated with the use of styrofoam peanuts 52 is reduced. That is, by the styrofoam peanuts 52 being maintained as a cohesive unit, they are less likely to become scattered across a room or blown by the wind thereby facilitating reuse or disposal of the styrofoam peanuts 52.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A packaging material for providing a protective cushion about an article, comprising:

a plurality of individual, narrow strips of Easter grass, each strip of Easter grass having a length; and a pressure sensitive adhesive disposed on each strip of Easter grass, wherein each strip of Easter grass is bondingly connected to adjacently disposed strips of Easter grass at more than one point along the length of the strip of Easter grass such that the strips of Easter grass are bondingly interconnected to one another so as to form a unitary, resilient tuft of Easter grass.

2. The packaging material of claim 1 wherein the strips of material are spot coated with the adhesive.

3. A packaging material for providing a protective cushion about an article, comprising:

a plurality of individual, narrow strips of Easter grass, each strip of Easter grass having a length; and a cohesive disposed on each strip of Easter grass, wherein each strip of Easter grass is bondingly connected to adjacently disposed strips of Easter grass at more than one point along the length of the strip of Easter grass such that the strips of Easter grass are bondingly interconnected to one another so as to form a unitary, resilient tuft of Easter grass.

4. The packaging material of claim 3 wherein the strips of material are spot coated with the cohesive.

5. A package, comprising:

a container;

an article positioned within the container; and a mass of randomly arranged individual, thin, flexible strips of Easter grass, each of the strips of Easter grass having a bonding material disposed thereon such that each strip of Easter grass is bondingly interconnected to the adjacently disposed strips of Easter grass at more than one point alone the length of the strip of Easter grass such that the strips of Easter grass are bondingly interconnected to one another so as to form a unitary, resilient tuft of Easter grass, the resilient tuft positioned in the container so as to cushioningly support at least a portion of the article.

6. The package of claim 5 wherein the resilient tuft is bondingly connected to the article.

7. The package of claim 5 wherein the resilient tuft is bondingly connected to the container.

8. The package of claim 5 wherein the resilient tuft is bondingly connected to the article and to the container.

9. The package of claim 5 wherein the bonding material is a pressure sensitive adhesive.

10. The package of claim 9 wherein the strips of material are spot coated with the adhesive.

11. The package of claim 5 wherein the bonding material is a cohesive.

12. The package of claim 11 wherein the strips of material are spot coated with the cohesive.

13. The package of claim 5 wherein the container is a basket.

14. A packaging material, comprising:

a plurality of individual, narrow strips of Easter grass, each strip of Easter grass having a length; and a pressure sensitive adhesive disposed on each strip of Easter grass, wherein each strip of Easter grass is bondingly connected to adjacently disposed strips of Easter grass at more than one point along the length of the strip of Easter grass such that the strips of Easter grass are bondingly interconnected to one another so as to form a unitary, resilient tuft of Easter grass which provides a protective cushion for an article positioned on the tuft and prevents the article from migrating through the tuft.

15. A packaging material, comprising:

a plurality of individual, narrow strips of Easter grass, each strip of Easter grass having a length; and a cohesive disposed on each strip of Easter grass, wherein each strip of Easter grass is bondingly connected to adjacently disposed strips of Easter grass at more than one point along the length of the strip of Easter grass such that the strips of Easter grass are bondingly interconnected to one another so as to form a unitary, resilient tuft of Easter grass which provides a protective cushion for an article positioned on the tuft and prevents the article from migrating through the tuft.

* * * * *